US007100252B2

(12) United States Patent
Anscher

(10) Patent No.: US 7,100,252 B2
(45) Date of Patent: Sep. 5, 2006

(54) DUAL LOCKING BUCKLE

(76) Inventor: Joseph Anscher, 1928 Midlane, Muttontown, NY (US) 11791

( * ) Notice: Subject to any disclaimer, the term of this patent is extended or adjusted under 35 U.S.C. 154(b) by 0 days.

(21) Appl. No.: 11/047,156

(22) Filed: Jan. 31, 2005

(65) Prior Publication Data

US 2006/0168783 A1 Aug. 3, 2006

(51) Int. Cl.
*A44B 11/25* (2006.01)

(52) U.S. Cl. ..... 24/615; 24/625; 24/616; 24/614

(58) Field of Classification Search ..... 24/615, 24/616, 625, 614
See application file for complete search history.

(56) References Cited

U.S. PATENT DOCUMENTS 4,688,337 A * 8/1987 Dillner et al. ..... 24/616
4,825,515 A * 5/1989 Wolterstorff, Jr. ..... 24/625
5,222,279 A 6/1993 Frano et al.
5,465,472 A * 11/1995 Matoba ..... 24/625
5,794,316 A * 8/1998 Anscher ..... 24/625
6,052,875 A 4/2000 Fudaki
6,615,460 B1 * 9/2003 Baumgarten ..... 24/615
D496,302 S 9/2004 Kaneko et al.
D496,303 S * 9/2004 Anscher ..... D11/216

* cited by examiner

*Primary Examiner*—Robert J. Sandy
*Assistant Examiner*—Marcus Menezes
(74) *Attorney, Agent, or Firm*—Collard & Roe, P.C.

(57) ABSTRACT

A buckle has a male and a female portion. The female portion has a hollow body with two sidewalls, an open receiving end and a locking end with an opening formed from the side walls. The opening is wider in a central area than at its ends. The male portion has at least one locking arm with a free end and a locking tab. Inserting the male portion into the female portion compresses locking arm, causing the locking tab to extend through the opening in the locking end. Inserting the male portion fully into the female portion causes tab to rest against one of the narrow ends of the opening in the locking end, to lock the male portion to the female portion. Pulling the male portion against the female portion causes the tab to lock even more firmly against the edges of the opening to prevent inadvertent disengagement.

8 Claims, 4 Drawing Sheets

DUAL LOCKING BUCKLE

BACKGROUND OF THE INVENTION

1. Field of the Invention

The invention relates to a buckle that is secured in two places, to increase its strength yet maintain a low weight and profile. In particular, the invention relates to a side-release buckle in which the male portion locks into the female portion in two places along the length of the female portion.

2. The Prior Art

Side release buckles are commonly used to attach to straps to one another. In a standard side-release buckle, the male portion has two prongs with locking tabs on the free ends. These locking tabs snap into slots in the female portion of the buckle to secure the two portions together.

In order to create a sufficiently strong buckle that will not release under stress, conventional buckles have had to be made in which the prongs of the male portion are very stiff and heavy. This makes the buckle difficult to release, and cumbersome. However, if the prongs are too flexible, the buckle will not be able to withstand high stresses.

It would be desirable to make a buckle where the buckle can withstand large amounts of stress without releasing, and yet be easy to operate, light in weight and attractive.

SUMMARY OF THE INVENTION

The invention comprises a buckle having a male portion and a female portion. The female portion has a hollow body with two sidewalls, an open receiving end and a locking end located opposite the receiving end. There is an opening in the locking end which is surrounded by the side walls of the female portion. These side walls meet to form a V-shaped aperture on each end.

The male portion comprises a base and at least one flexible locking arm connected to the base. The locking arm has a free end and a locking tab located at the free end. The arm is flexible at an end located near the base. Inserting the male portion into the female portion compresses locking arm inward, allowing it to slide into the female portion until the locking tab extends through the slot in the locking end. Insertion of the male portion fully into the female portion causes the locking arm to pass through the aperture in the locking end and be released into a resting position where the locking tab rests against one of the V-shaped narrow ends of the aperture in the locking end, to lock the male portion to the female portion. The locking arm has a V-shaped profile as well, to fit directly into the V-shaped opening created by the side walls of the female portion once the locking tab passes fully through the opening. The tab has a shoulder portion that abuts the edges of the opening to prevent release of the male portion without first forcing the locking arms inward to make the shoulders clear the opening.

Pulling the male portion against the female portion after the male and female portions are locked together causes the tab to lock even more firmly against the side walls of the female portion to prevent inadvertent disengagement of the male portion from the female portion, since the locking tab is wider than the V-shaped end of the opening and cannot pass through the opening without being first moved into the central area of the opening, where the opening is wide enough for the locking tab to pass through.

In one embodiment, there is least one locking slot in at least one of the sidewalls of the female portion, and there is a shoulder portion located remote from the free end of the locking arm of the male portion. The shoulder portion protrudes outwardly from the locking arm. Inserting the male portion into the female portion causes the shoulder portion to extend through the locking slot to abut a top end of the locking slot and further lock the male portion to the female portion. The male portion is released from the female portion by pressing the shoulder portion inward until the shoulder portion clears the locking slot, which also moves the tab inward to the central area of the opening in the locking end, to release the male portion from the female portion. The inward pressure against the locking arm also creates a longitudinal force vector, due to the pivoting motion of the flexible locking arm. This longitudinal force vector forces the male portion out of the female portion after the locking arm has been released from the slot and opening.

In a preferred embodiment, there are two locking slots and two locking arms. Each of the male and female portions may have a strap retaining bar at their remote ends, to allow for a strap to be attached to each of the portions. The buckle is useful for many different applications, such as backpack straps, belt buckles, seat belts, or any other application where it is desirable to releasably connect two straps together.

In another embodiment, the receiving end of the female portion comprises a V-shaped groove and the male portion has a corresponding V-shaped central section extending from the base. Inserting the male portion into the female portion causes the central section to rest in the groove to align the male portion with the female portion, thus making it easier to connect the male and female portions together, especially in low light situations. The V-shaped sections automatically align the male and female portions with each other, even if they are initially not aligned.

The central section may have a mesh portion having a thickness that is less than the thickness of the surrounding area. The mesh portion has a plurality of apertures therethrough, thus decreasing the weight of the buckle and the amount of plastic needed to manufacture the buckle. The mesh area is also aesthetically pleasing.

In another embodiment, the locking end of the female portion extends longitudinally in the central area, to extend beyond the tabs of the male portion when they are locked into the slot of the female portion. This extending area protects the tabs while they are locked in and prevents inadvertent disengagement of the male portion from the female portion by preventing external objects from pressing the tabs inward.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
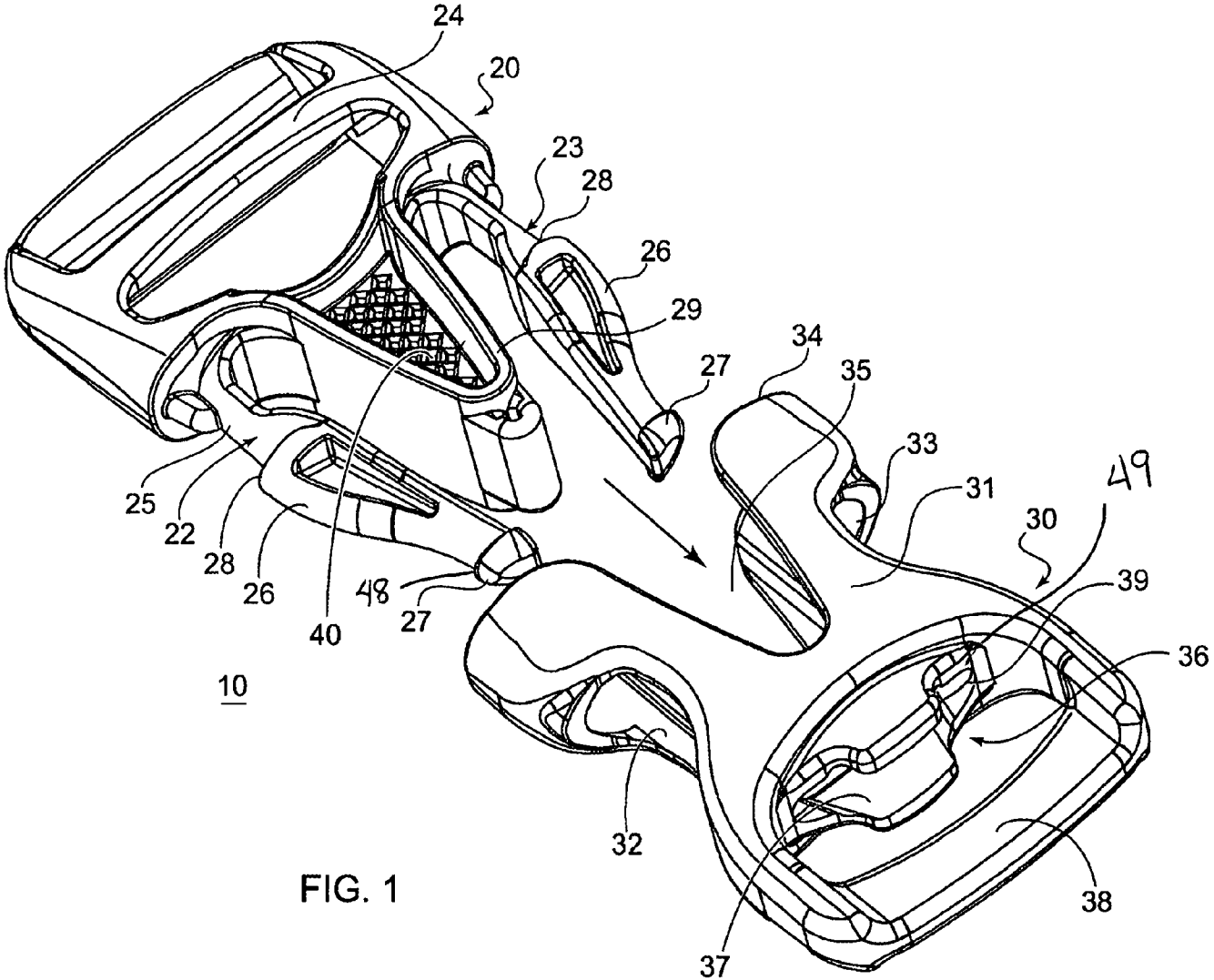
FIG. 1 shows a perspective view of one embodiment of the buckle in an unlocked position.

Referring now in detail to the drawings, FIG. 1 shows a buckle 10 having a male portion 20 and a female portion 30. Male portion 20 has a base 21, two locking arms 22, 23 and a strap retaining bar 24. Locking legs 22, 23 each have a flexible top section 25, a shoulder portion 26 and a locking tab 27 disposed at their free ends. Shoulder portion 26 has a top ridge 28 that extends outward from arms 22, 23 to form an abutting surface. Also extending from base 21 is a central portion 29, having a V-shaped profile and a mesh inner section 40. Mesh section 40 has a thickness that is much less than the thickness of the surrounding section of central portion 29. Mesh section 40 has a plurality of holes therethrough. Mesh section 40 serves to decrease the weight of buckle 10 and make it more attractive.

Female portion 30 has a hollow main body 31 formed of upper and lower sidewalls separated by a cavity, two locking slots 32, 33, a top receiving end 34 having a V-shaped slot 35, and a locking end 36 having an opening 37. Opening 37 is wider in its central area and narrows toward its ends 39. There is also a strap retaining bar 38.

Figure 2:
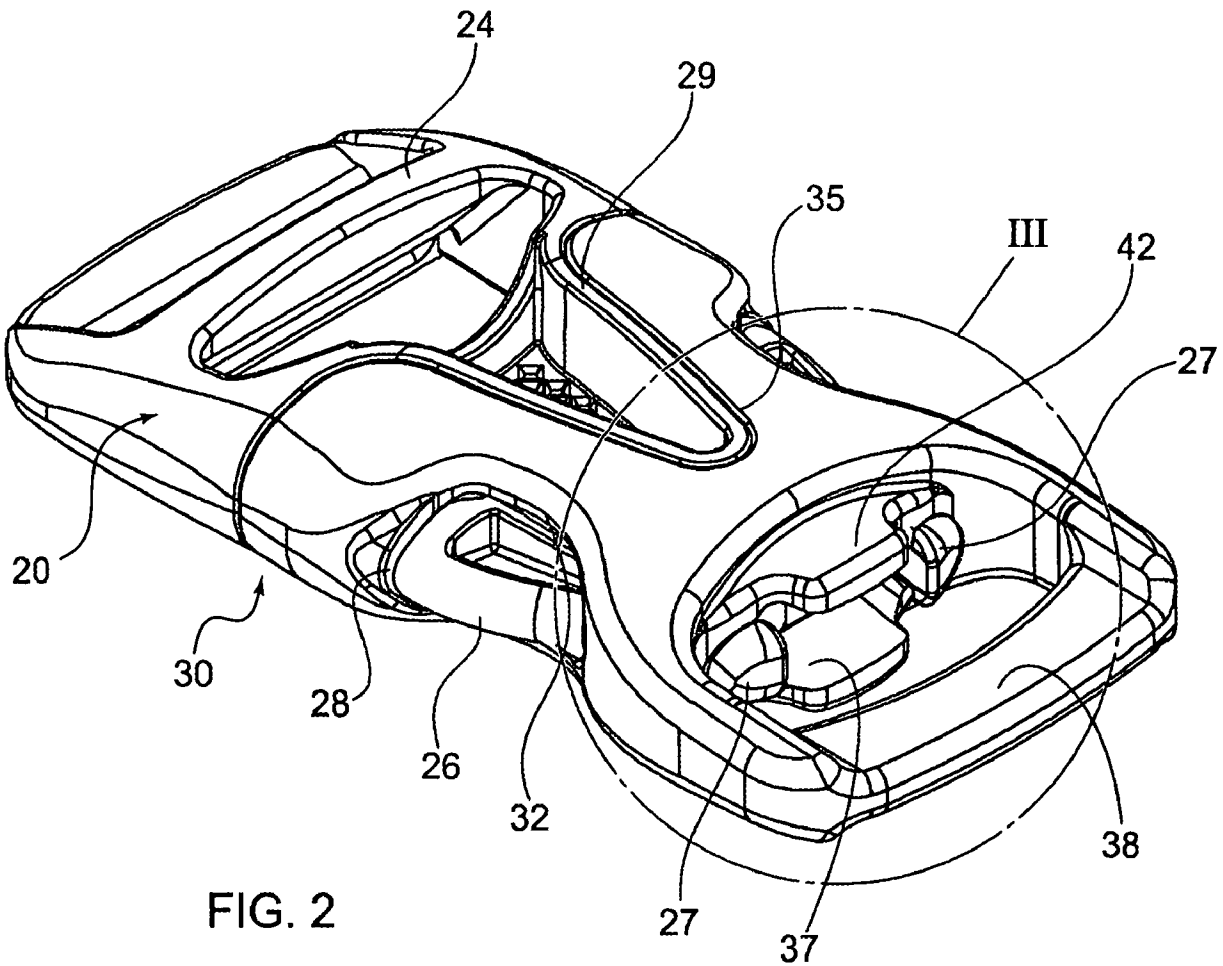
FIG. 2 shows a perspective view of the buckle of FIG. 1 in a locked position.
Figure 3:
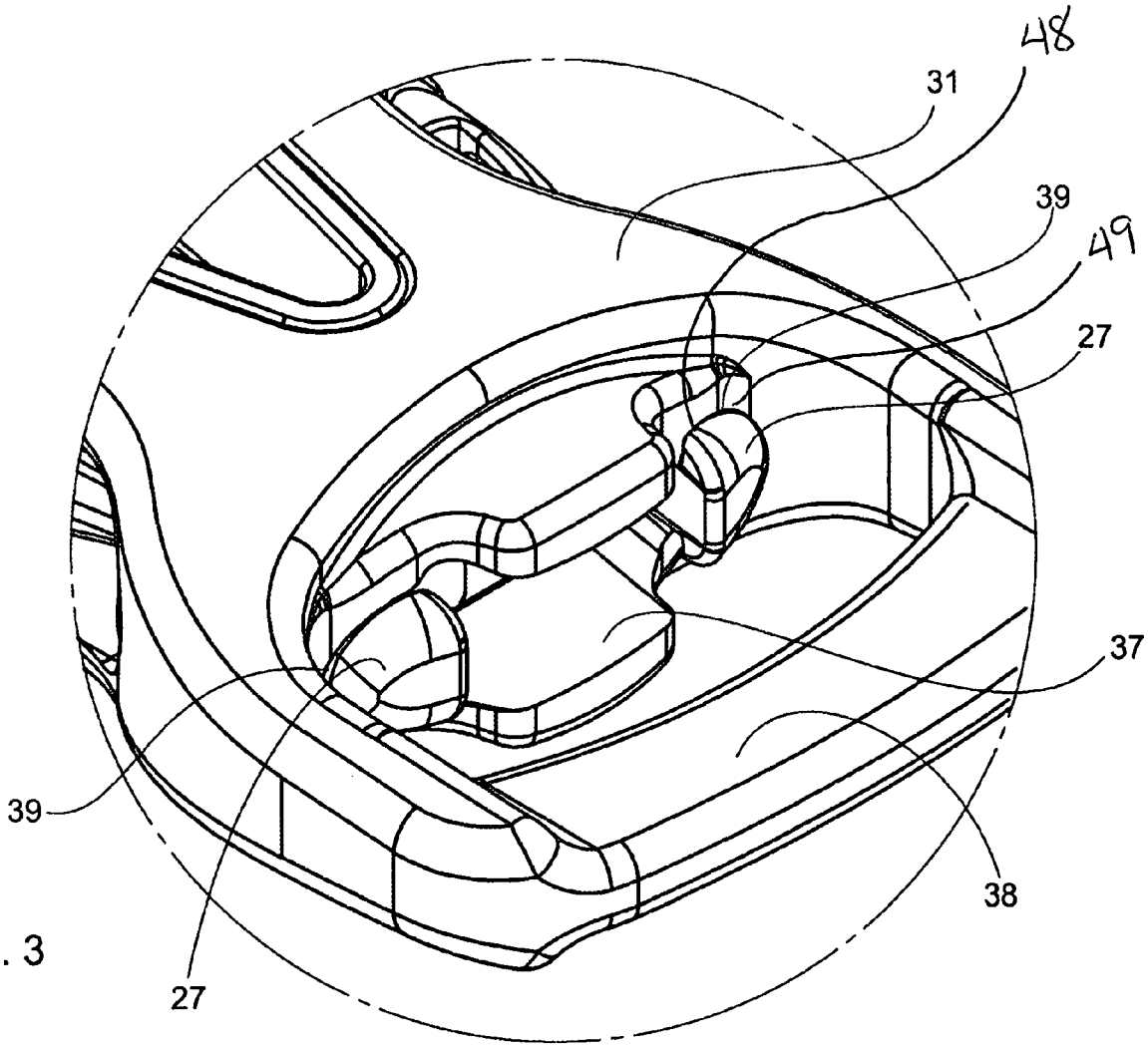
FIG. 3 shows an enlarged view of section III of FIG. 2.
Figure 4:
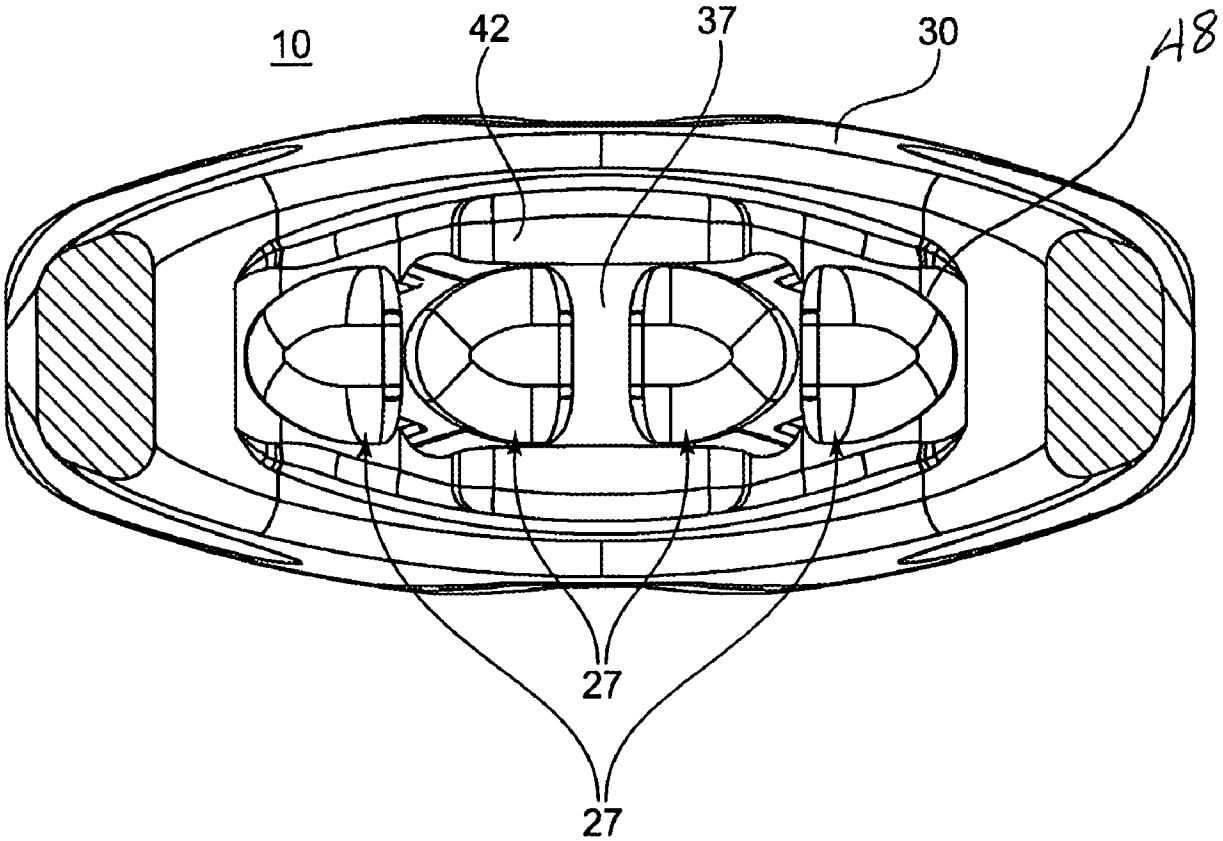
FIG. 4 shows an end view of the buckle of FIGS. 1–3, showing the tabs of the male portion in a compressed and resting position.

FIG. 2 shows male portion 20 fully inserted into female portion 30. During insertion, the side walls of female portion 30 force locking arms 22, 23 inward and allow shoulder portions 26 to slide into female portion 30. The sloped profile of shoulder portions 26 assists in this movement. Upon full insertion of male portion 20 into female portion 30, shoulder portions 26 snap into locking slots 32. At the same time, tabs 27, which in a compressed position were located in the wide central area of slot 37, extend fully through opening 37 and spring out to snap into narrow ends 39 of opening 37 (See also FIG. 4). Top ridge 28 of shoulder portions 26 extend beyond locking slot 32 and lock male portion 20 into female portion 30. At the same time, tabs 27 lock into opening 37 by shoulder portions 48 abutting edges 49 of end portions 39 of opening 37 and also prevent any release of male portion 20, as can be seen in FIGS. 3 and 4. In fact, lateral pressure of male portion 20 away from female portion 30 causes shoulders 39 of tabs 27 to lock even more firmly into edges 49 of opening 37.

During insertion of male portion 20 into female portion 30, V-shaped central portion 29 slides into V-shaped groove 35 of female portion 30, to help align male portion 20 with female portion 30. Male portion 20 can be placed into female portion 30 initially off-center, but the V-shaped cooperating surfaces serve to precisely align the two buckle parts for secure locking. This is especially useful in low light situations or when the user is moving and cannot precisely align the two buckle parts before connecting them.

FIG. 4 shows an end view of buckle 10, showing tabs 27 in an initially inserted and in a locking position. Upon initial insertion, side walls 31 of female portion 30 compress locking arms 22, 23 of male portion 20 and allow tabs 27 to be inserted fully through opening 37 in a central area, which is wide enough to allow tabs 27 to pass through. After tabs 27 have passed opening 37 and male portion is fully inserted into female portion 30, locking arms 22, 23 snap into a resting position and tabs 27 snap into ends 39 of opening 37. Ends 39, shown in FIG. 1, are narrower than tabs 27, and do not allow tabs 27 to pass back into the body of female portion 39, due to the width of shoulders 48 of tabs 27, thus locking male portion 20 into female portion 30. Ends 39 preferably have a V-shaped profile and are surrounded by edges 49, which abut shoulders 48 of tabs 27. Arms 22, 23 preferably have a V-shaped cross section at their ends near tabs 27, so that arms 22, 23, fit directly into ends 39 and prevent tabs 27 from inadvertently releasing from opening 37.

To release male portion 20, the user presses inwardly on shoulder portions 26 until they clear locking slots 32. This also moves tabs 27 back into the central area of opening 37 and allows shoulders 48 of tabs 27 to clear edges 49 and pass back through opening 37 as male portion 20 slides out of female portion 30. The pressing motion against shoulder portions 26 causes locking arms 22, 23 to pivot inward, and also creates a longitudinal force vector that forces male portion 20 out of female portion 30 once shoulder portion 26 and locking tab 27 is released.

On either side of the central area of slot 37, the body of female portion 30 extends outwardly in tabs 42. Tabs 42 protect tabs 27 from being inadvertently pressed inward by outside forces during use, by blocking any access to tabs 27 from the outside.

The buckle according to the invention provides a secure locking action, because the buckle is locked in two places, and longitudinal forces on the buckle only cause the buckle to be locked in more securely. The buckle according to the invention provides an extremely secure lock, and yet is light and flexible, thus making it easy to use.

Accordingly, while only a few embodiments of the present invention have been shown and described, it is obvious that many changes and modifications may be made thereunto without departing from the spirit and scope of the invention.

What is claimed is:

1. A buckle comprising:

a female portion comprising:

a hollow body with two sidewalls, an open receiving end and a locking end located opposite said receiving end;

an opening in said locking end, said opening being formed by said two sidewalls and having two ends and being wider in a central area than at said ends;

at least one locking slot in at least one of said sidewalls; and a male portion comprising:

a base;

at least one locking arm connected to said base, said locking arm having a free end and a locking tab located at said free end; and a shoulder portion located remote from said free end of said locking arm, wherein inserting the male portion into the female portion compresses locking arm inward and causes the locking tab to pass fully through the opening in the locking end and wherein once the locking tab passes through the opening in the locking end the locking arm is released into a resting position where the tab rests against one of the ends of the opening in the locking end, to lock the male portion to the female portion, wherein inserting the male portion into the female portion causes the shoulder to extend through the locking slot to abut a top end of the locking slot and further lock the male portion to the female portion, and wherein the male portion is released from the female portion by pressing the shoulder portion inward until the shoulder portion clears the locking slot, which also moves the tab inward to the central area of the opening in the locking end, to release the male portion from the female portion.

2. The buckle according to claim 1, wherein there are two locking slots and two locking arms.

3. The buckle according to claim 1, further comprising a strap retaining bar disposed on at least one of the male and female portions.

4. The buckle according to claim 1, wherein the receiving end comprises a V-shaped groove and wherein the male portion has a corresponding V-shaped central section connected to said base, wherein inserting the male portion into the female portion causes the central section to rest in the groove to align the male portion with the female portion.

5. The buckle according to claim 4, wherein the central section has a mesh portion having a thickness that is less than a thickness of a surrounding area, said mesh portion having a plurality of apertures therethrough.

6. The buckle according to claim 1, wherein the locking end of the female portion extends longitudinally in the central area.

7. The buckle according to claim 1, wherein the shoulder portion comprises an upper ridge that forms an abutting surface, said abutting surface extending through the locking slot and abutting the female portion when the shoulder portion extends through the locking slot.

8. The buckle according to claim 1, wherein the ends of the opening have a V-shape and wherein the locking arm has a V-shaped cross section, so that when the male portion is fully inserted into the female portion, the locking arm fits securely into one of the ends of the opening.

* * * * *